US009352563B2

(12) United States Patent
Watanabe et al.

(10) Patent No.: US 9,352,563 B2
(45) Date of Patent: May 31, 2016

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/453,299

(22) Filed: Aug. 6, 2014

(65) Prior Publication Data

US 2015/0042722 A1 Feb. 12, 2015

(30) Foreign Application Priority Data

Aug. 9, 2013 (JP) ..... 2013-167011

(51) Int. Cl.
*B41J 2/135* (2006.01)
*B41J 2/14* (2006.01)

(52) U.S. Cl.
CPC .... *B41J 2/14145* (2013.01); *B41J 2002/14419* (2013.01)

(58) Field of Classification Search
CPC ..... B41J 2/175; B41J 2002/14491; B41J 2002/14362; B41J 2002/14419; B41J 2/14; B41J 2/1433; B41J 2/14145; B41J 2002/14411
USPC ..... 347/40, 44, 49, 85
See application file for complete search history.

(56) References Cited

FOREIGN PATENT DOCUMENTS

JP 2006-082317 3/2006

*Primary Examiner* — Jannelle M Lebron
(74) *Attorney, Agent, or Firm* — Workman Nydegger

(57) ABSTRACT

A liquid ejecting head is disclosed. The liquid ejecting head includes a liquid inlet which is provided on one surface of the liquid ejecting head and to which a liquid maintaining portion that maintains liquid is connected, a recessed portion in which the liquid inlet is provided on an inner side and which is open to the one surface, a groove portion which is continuously provided across a vicinity of the recessed portion on an outer side of the recessed portion, and open to the one surface, and a communication path which communicates with a side surface where the groove portion and the one surface intersect with each other, or with a surface opposite to the one surface.

14 Claims, 5 Drawing Sheets

LIQUID EJECTING HEAD AND LIQUID EJECTING APPARATUS

CROSS REFERENCE TO RELATED APPLICATIONS

The present application claims priority to Japanese Patent Application No. 2013-167011 filed on Aug. 9, 2013, which is hereby incorporated by reference in its entirety.

BACKGROUND

1. Technical Field

Embodiments of the present invention relate to a liquid ejecting head which ejects liquid from a nozzle and a liquid ejecting apparatus. More particularly, embodiments relate to an ink jet type recording head that discharges a liquid such as ink and to an ink jet type recording apparatus.

2. Related Art

Representative examples of a liquid ejecting head that ejects liquid include an ink jet type recording head that discharges ink droplets. The ink jet type recording head may have, for example, a head body that discharges the ink droplets from a nozzle and a flow path member that supplies ink to the head body from a liquid maintaining portion. An ink cartridge which is fixed to the head body and maintains the ink is an example of a liquid maintaining portion (for an example, refer to JP-A-2006-82317).

In the flow path member of the ink jet type recording head, an ink absorber is provided in the vicinity of a liquid inlet which is connected to the liquid maintaining portion. The ink absorbed by the ink absorber is discharged from an outlet.

However, when a large amount of the ink is leaked, the ink absorber is not able to absorb the ink. As a result, the ink spills and the spilled ink may reach an electronic component. Therefore, there is a concern that damage to the electronic component may occur or that a short circuit may be caused or other defect may occur.

In addition, these problems exist not only in the ink jet type recording head, but also in liquid ejecting heads that eject liquids other than ink.

SUMMARY

Advantages of some embodiments of the present invention include providing a liquid ejecting head and a liquid ejecting apparatus that can suppress liquid from leaking from or to an unexpected place and suppress defects caused by the leaked or spilled ink.

According to one embodiment of the present invention, a liquid ejecting head is provided. The liquid ejecting head may include a liquid inlet that is provided on one surface of the liquid ejecting head and to which a liquid maintaining portion that maintains liquid is connected, a recessed portion in which the liquid inlet is provided on an inner side and which is open to the one surface, a groove portion which is continuously provided across the vicinity of the recessed portion on an outer side of the recessed portion, and open to the one surface, and a communication path that communicates with a side surface where the groove portion and the one surface intersect with each other, or with a surface opposite to the one surface.

According to one embodiment, the liquid leaked to the one surface is discharged from the communication path via the groove portion. Therefore, it is possible to suppress defects caused by the liquid in an unexpected region.

In one embodiment, it is useful to have an opening which exposes the recessed portion, and to have a cover member which is formed from an outer side of the groove portion to a region that opposes a wall surface of the outer side of the groove portion. By covering the region from the outer side of the groove portion to the region that opposes the groove portion by the cover member, it is possible to guide the liquid attached to the cover member and to discharge the liquid from the communication path via the groove portion.

In addition, the recessed portion may be formed by a guide wall for positioning the liquid maintaining portion provided in the vicinity of the connection portion. According to this, the liquid maintaining portion is positioned by the guide wall and reliably maintained.

In addition, the groove portion may have a narrow opening width on a side which communicates with the communication path, and may have a wide opening width on a side opposite to a side which communicates with the communication path. According to this, by increasing a buffer volume that maintains the liquid of the groove portion separated apart from the communication path, it is possible to suppress the liquid from spilling or leaking from the groove portion.

In addition, a wiring substrate may have a connector to which an outer portion wiring is connected, and the connector may be disposed to be a surface different from a surface on which the communication path is provided. According to this, it is possible to suppress attachment of the liquid to the connector, and to suppress damage to an electronic component of the wiring substrate or a short circuit of a wiring.

In addition, a discharging groove may have a recessed shape along a circumferential direction and may be provided in the vicinity of the liquid inlet. The discharging groove may be provided so as to be communicated with the groove portion. According to this, it is possible to discharge the liquid from the communication path via the groove portion from the discharging groove.

Furthermore, according to another embodiment of the present invention, a liquid ejecting apparatus which has the liquid ejecting head of the above-described embodiments is provided.

According to the aspect, it is possible to realize the liquid ejecting apparatus which suppresses a defect or problems caused by liquid (e.g., spilled or leaked ink) that has infiltrated into an unexpected region or location.

BRIEF DESCRIPTION OF THE DRAWINGS

Embodiments of the present invention will be described with reference to the accompanying drawings, wherein like numbers reference like elements.

DESCRIPTION OF EXEMPLARY EMBODIMENTS

Hereinafter, embodiments of the present invention will be described in detail.

Figure 1:
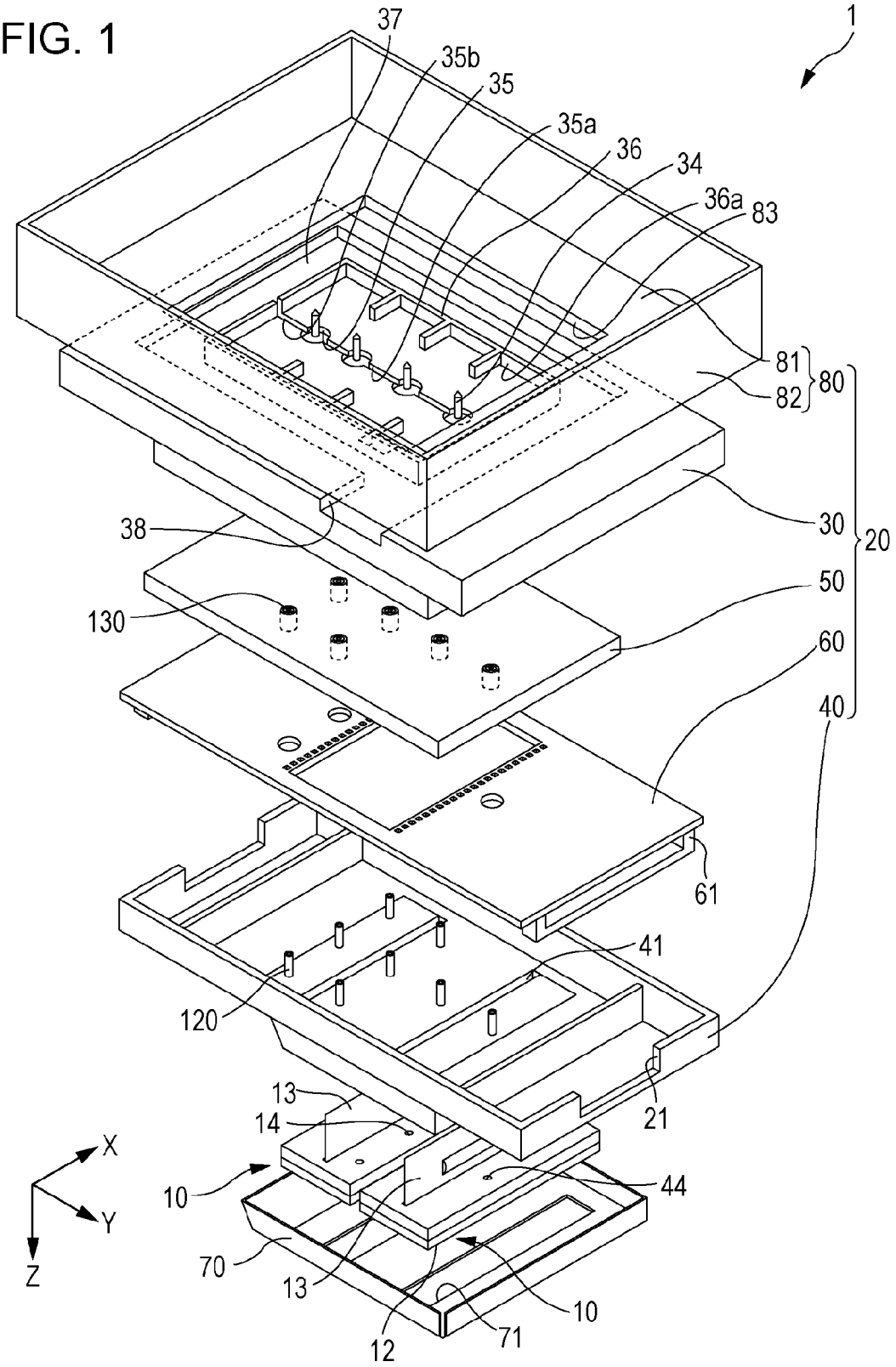
FIG. 1 is an exploded perspective view of an example of a recording head.
Figure 2:
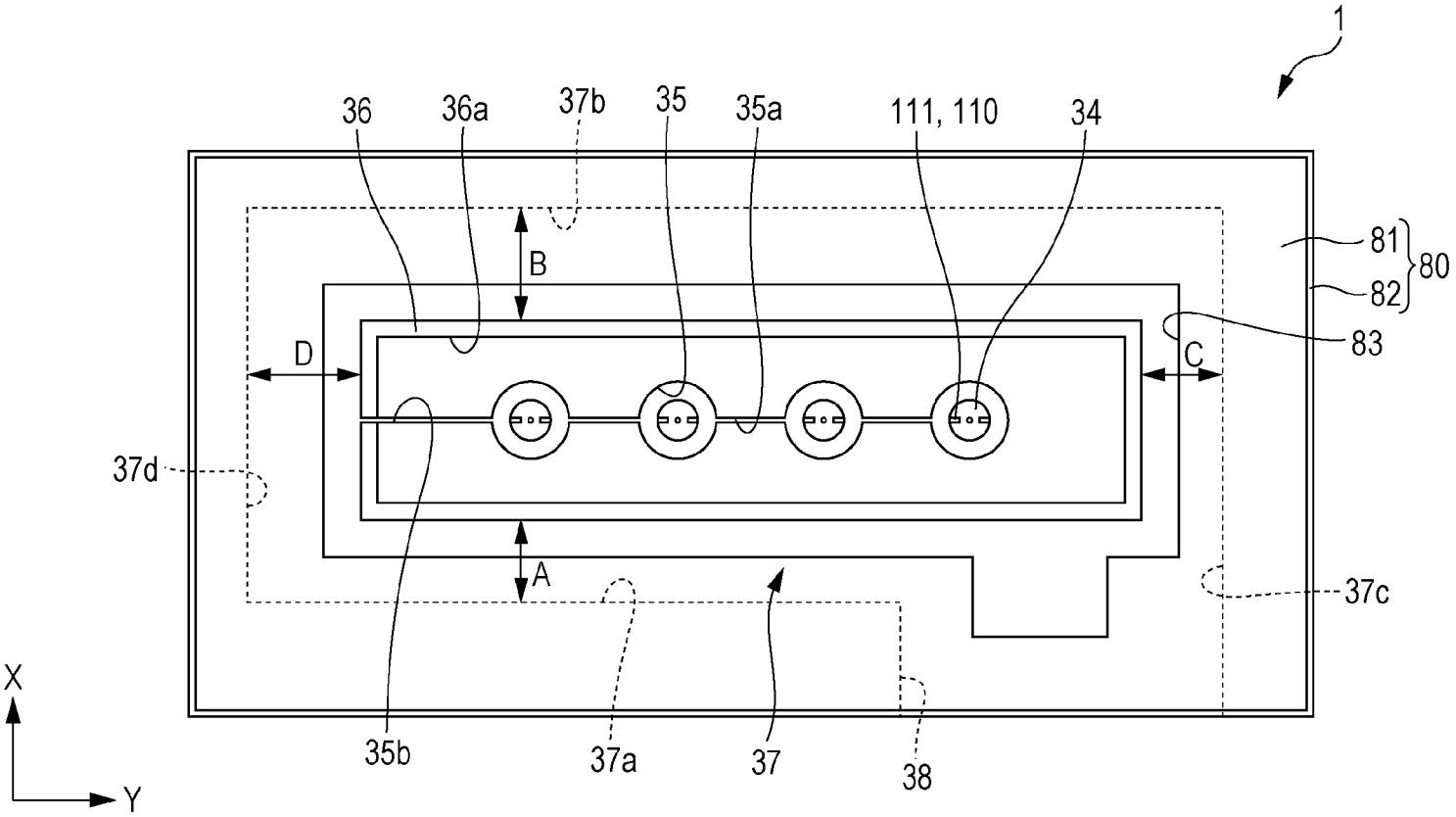
FIG. 2 is a plan view of the recording head.
Figure 3:
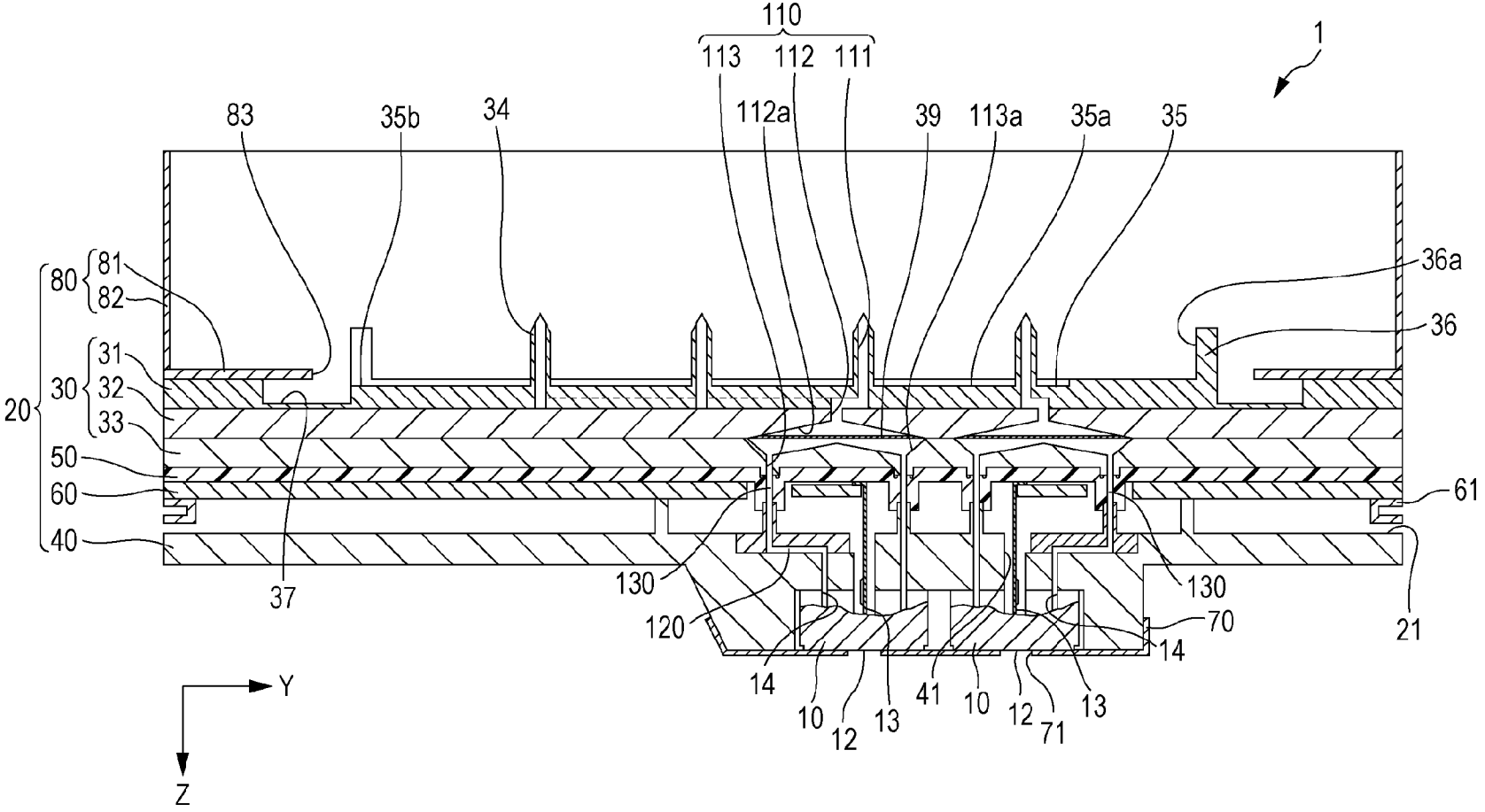
FIG. 3 is a cross-sectional view of the recording head
Figure 4:
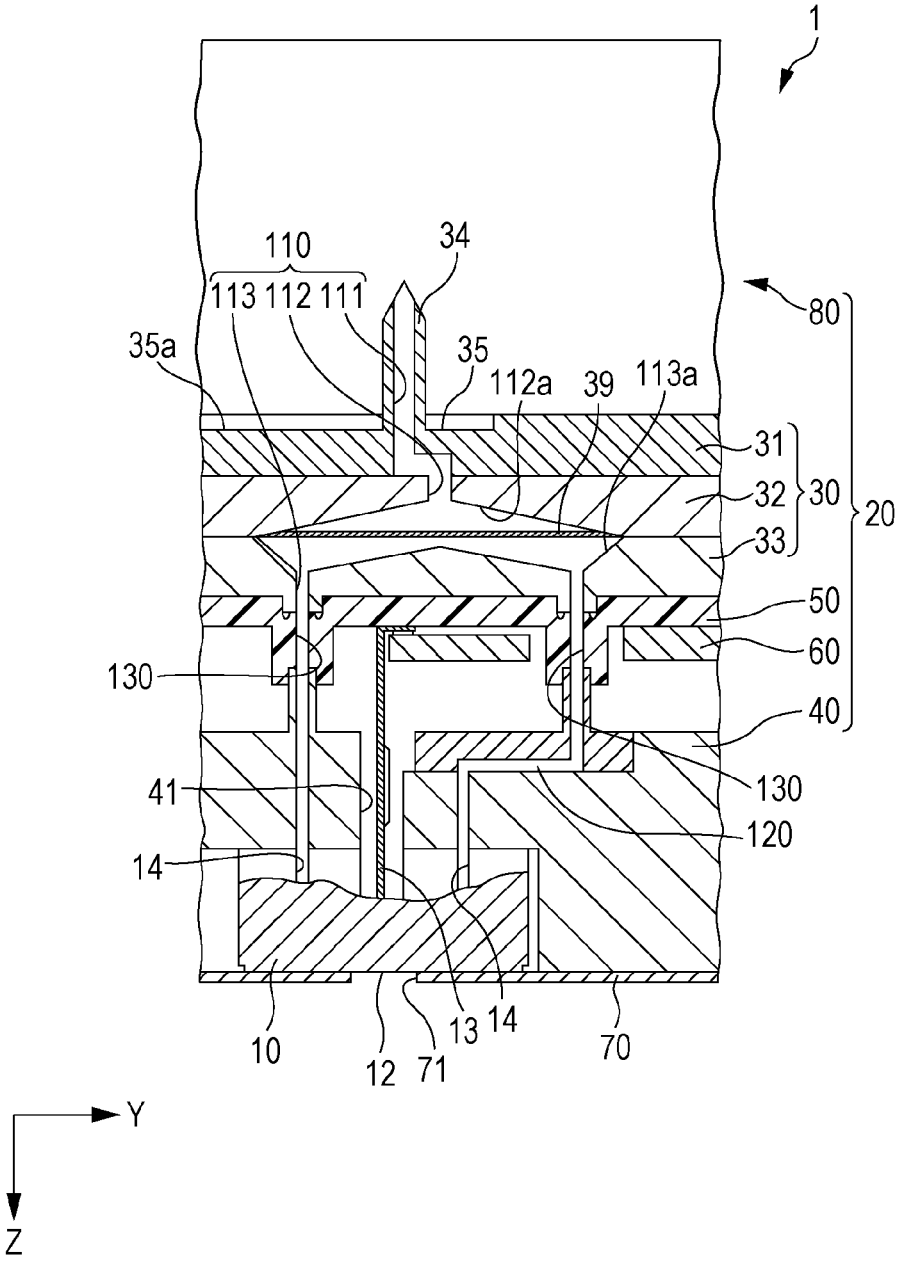
FIG. 4 is a cross-sectional view which enlarges an essential part of the recording head.

FIG. 1 is an exploded perspective view of an ink jet type recording head. The ink jet type recording head is an example of a liquid ejecting head. FIG. 2 is a plan view of the ink jet type recording head. FIG. 3 is a cross-sectional view of the ink jet type recording head. FIG. 4 is a cross-sectional view which enlarges a part of FIG. 3.

As illustrated in the drawings, an ink jet type recording head 1 (hereinafter, referred to as a recording head 1), which is an example of a liquid ejecting head, includes a plurality of head bodies 10 which discharge ink droplets from a nozzle, a flow path member 20 which maintains the plurality of head bodies 10 and is provided with or includes a liquid flow path that supplies liquid to the head body 10, and a cover head 70 which is maintained on a liquid ejecting surface side of the head body 10.

The head body 10 is provided with a liquid ejecting surface 12 on which the nozzle that discharges the ink droplets as the liquid to one surface is open. On the liquid ejecting surface 12, two nozzle rows (not illustrated specifically) in which the nozzles are provided in parallel are provided in a direction that intersects with a parallel direction of the provided nozzles. Here, the parallel direction of the provided nozzles in one nozzle row is referred to as a first direction X, and a row direction of the nozzle row that intersects with the first direction X is referred to as a second direction Y.

In addition, in the inside (not illustrated) of the head body 10, a flow path which communicates with the nozzle and with the liquid flow path of the flow path member 20 and pressure generating means which generates a pressure change to the ink inside the flow path, and the like are provided. It is possible to use pressure generating means for discharging the ink droplets from the nozzle by changing a capacity of the flow path according to a deformation of a piezoelectric actuator having a piezoelectric material with an electromechanical conversion function and by generating the pressure change to the ink inside the flow path. It is possible to use pressure generating means for discharging the ink droplets from the nozzle by disposing a heating element in the flow path and by bubbles generated by heat from the heating element. It is possible to use pressure generating means that include a so-called electrostatic actuator which discharges the ink droplets from the nozzle by generating an electrostatic force between a diaphragm and an electrode and by deforming the diaphragm by the electrostatic force.

In addition, in the head body 10, a wiring member 13 connected to pressure generating means inside the head body 10 is provided on a surface side of the head body 10 opposite to the liquid ejecting surface 12. On the surface side opposite to the liquid ejecting surface 12 of the head body 10, an inlet 14 is provided to supply the ink (liquid) to the flow path in the head body 10 on both sides of the wiring member 13 in the second direction Y. The liquid is provided to the flow path through the inlet 14.

The surface side of the head body 10 opposite to the liquid ejecting surface 12 is fixed to the flow path member 20. The ink which is maintained in the liquid maintaining portion, such as an ink cartridge or an ink tank, is supplied from the inlet 14 via the flow path member 20.

In addition, in the flow path member 20, a plurality of head bodies 10 are provided. In one example, two head bodies 10 are provided in parallel in the second direction Y which is the parallel direction of the nozzle rows. In other words, in one recording head 1, 4 nozzle rows in total are provided in parallel in the second direction Y. In addition, in one embodiment, a fixed direction between the flow path member 20 and the head body 10 is referred to as a third direction Z. In other words, the fixed direction between the flow path member 20 and the head body 10 is or may be referred to as a stacked direction, a direction perpendicular to a surface direction (in-surface direction of the first direction X and the second direction Y) of the liquid ejecting surface 12, and a direction in which the ink droplets are discharged.

In addition, the number of inlets 14 of the head body 10 is not particularly limited. In one embodiment that includes two head bodies 10, one of the two head bodies 10 may include two inlets 14 and the other head body 10 may include in one head body 10. In this example, one type of ink (liquid) may be discharged from one head body 10 with two inlets 14, and three types of ink (liquid) are discharged from the other head body 10 that includes 6 inlets 14. The number of inlets 14 included in any given head body 10 however is not limited.

Moreover, a fixing method between the head body 10 and the flow path member 20 is not particularly limited. For example, the fixing method may be adhesion with an adhesive, or fixation with a screw. However, since the size of the head body 10 is small and a plurality of the head bodies 10 may be attached to one flow path member 20, it is difficult to fix the head body 10 and the flow path member 20 via a seal member made of an elastic material. Therefore, it is useful to attach the head body 10 and the flow path member 20 with the adhesive.

The flow path member 20 to which the head body 10 is fixed may include an upstream flow path member 30 provided with an upstream flow path 110 to which the liquid maintaining portion is connected, a downstream flow path member 40 provided with a downstream flow path 120 which communicates with the upstream flow path 110, a seal member 50 which is provided between the upstream flow path member 30 and the downstream flow path member 40 and that, seals a connected part between the upstream flow path 110 and the downstream flow path 120, a wiring substrate 60 which is provided between the upstream flow path member 30 and the downstream flow path member 40, and a cover member 80 which is provided on a side opposite to the downstream flow path member 40 in the upstream flow path member 30.

In one embodiment, a first upstream flow path member 31, a second upstream flow path member 32, and a third upstream flow path member 33 are stacked in the upstream flow path member 30 in the third direction Z which is a direction in which the ink droplets are discharged. In addition, the upstream flow path member 30 is not particularly limited thereto. The upstream flow path member 30 may be a single member, or may include two or more members. The stacked direction of the plurality of members or member that constitutes the upstream flow path member 30 is also not limited thereto. The stack direction may also be the first direction X or the second direction Y.

The first upstream flow path member 31 may include a connection portion 34 which is connected to the liquid maintaining portion, such as the ink tank or the ink cartridge in which the ink (liquid) is maintained, on a surface side opposite to the downstream flow path member 40. In one embodiment, the connection portion 34 may have a protruded needle shape. The shape of the connection portion 34 is not limited to the needle shape. The shape of the connection portion 34 may be a cylindrical shape, or the like. In addition, the liquid maintaining portion, such as the ink cartridge, may be directly connected to the connection portion 34 The liquid maintaining portion, such as the ink tank, may be connected to the connection portion 34 via a supply tube, such as a tube. A first upstream flow path 111 to which the ink is supplied from the liquid maintaining portion is provided inside the connection portion 34. In one embodiment, the first upstream flow path 111 is open at a tip end of the connection portion 34 and is referred to as a liquid inlet to which the liquid maintaining portion is connected. In addition, the first upstream flow path 111 is configured to have a flow path which extends in the third direction Z, and/or a flow path which extends in a direction perpendicular to the third direction Z. That is, the flow path may extend on a surface including the first direction X and the second direction Y according to a position of a second upstream flow path 112 which will be described below.

In the vicinity of each connection portion 34 of the first upstream flow path member 31, a discharging groove 35 having a recessed shape is provided. In addition, the discharging grooves 35 adjacent to each other communicate with each other via a first communication groove 35*a*. Here, the recessed shape indicates that the discharging groove 35 is a non-through-hole which is formed in the flow path member 20 without penetrating the flow path member 20 in the third direction Z. The discharging groove 35 may be continuously provided across the circumferential direction in the outer circumference of the connection portion 34. In other words, on a bottom surface (surface in the third direction Z) of the discharging groove 35, a base end portion of the connection portion 34 is provided. Ink that leaks to an outer side of the connection portion 34 remains in the discharging groove 35 and is discharged to the outside via the discharging groove 35 and the first communication groove 35*a* (to be described below in detail).

In addition, in the vicinity of the connection portion 34 (discharging groove 35) of the first upstream flow path member 31, a guide wall 36 for positioning the liquid maintaining portion is provided. The guide wall 36 is provided with a plurality of connection portions 34. The guide wall 36, in one embodiment, is provided to surround the vicinity of four connection portions 34. A recessed portion 36*a* having a recessed shape, which is open on the surface side opposite to the downstream flow path member 40, is provided in the third direction Z on an inner side of the guide wall 36. In other words, the connection portion(s) 34 (liquid inlet) is provided on the inner side of the recessed portion 36*a* on a bottom surface of the recessed portion 36*a*. Moreover, the recessed shape indicates that the recessed portion is the non-through-hole which is formed without penetrating the flow path member 20 in the third direction Z.

In addition, a groove portion 37 is provided on an outer circumferential side of the recessed portion 36*a*, which is continued across the vicinity of the recessed portion 36*a*. In other words, the groove portion 37 is continuously provided across or around the vicinity of the guide wall 36 on an outer side of the guide wall 36.

In addition, the upstream flow path member 30 includes a communication path 38. The communication path 38 communicates with the groove portion 37 and a side surface that intersects with a surface on which the connection portion 34 (liquid inlet) is provided. In other words, the side surface which intersects with a surface, on which the connection portion 34 (liquid inlet) is provided, is a surface which faces the flow path member 20 in the first direction X or the second direction Y. In one embodiment, the communication path 38 is open to a surface on which a connector 61 connected to an outer portion wiring of the wiring substrate 60 (to be described below in detail) is not provided, that is, on one surface of the first direction X. The communication path 38 is formed with substantially the same depth (in the third direction Z) as the groove portion 37. The communication path 38 may be provided to be inclined to have a depth (third direction Z) which becomes gradually deeper toward the side surface of the flow path member 20. Accordingly, it is possible to easily discharge the ink to the outside of the recording head 1 from the communication path 38.

In addition, the groove portion 37 is for maintaining or discharging the ink leaked from the liquid maintaining portion or the upstream flow path 110 when the liquid maintaining portion is attached to and detached from the connection portion 34, or the like. The ink maintained in the groove portion 37 is discharged to the outside of the recording head 1 via the communication path 38. For this reason, by making the communication path 38 open to the surface on which the connector 61 is not provided, it is possible to suppress the discharged ink from attaching to the connector 61, and to suppress ink from short circuiting the wiring or from damaging the electronic components.

Here, the groove portion 37 is provided across or in the vicinity of the recessed portion 36*a*. The groove portion 37 may include a first edge 37*a* and a second edge 37*b* which are provided on both sides of the recessed portion 36*a* in the first direction X, and a third edge 37*c* and a fourth edge 37*d* which are provided on both sides of the recessed portion 36*a* in the second direction Y. In one example, the communication path 38 is provided on the edge portion of the first edge 37*a* on the third edge 37*c* side.

Here, the groove portion 37 may be formed to have a narrow opening width in a region near the communication path 38, and to have a wide opening width in a region separated from the communication path 38. In other words, an opening width A of the first edge 37*a* which communicates with the communication path 38 and an opening width C of the third edge 37*c* which is near to the communication path 38 are narrower than an opening width B of the second edge 37*b* and an opening width D of the fourth edge 37*d* which are separated from the communication path 38. Moreover, the opening width mentioned here indicates a width in a direction perpendicular to a direction in which the ink flows inside the groove portion 37.

In this manner, by making the opening width of the groove portion 37 as narrow as that of the communication path 38 side, and as wide as the region separated from the communication path 38, it is possible to increase an amount of space for storing the ink inside the second edge 37*b* and the fourth edge 37*d*, and to suppress the ink from spilling from the groove portion 37 (the second edge 37*b* and the fourth edge 37*d*). In other words, it is possible to immediately discharge the ink maintained in the groove portion 37 (by the first edge 37*a* and the third edge 37*c*) which is near the communication path 38, through the communication path 38. However, since the ink maintained in the groove portion 37 (by the second edge 37*b* and the fourth edge 37*d*) in a region far from the communication path 38 is discharged from the communication path 38 via the first edge 37*a* and the third edge 37*c*, there is a case where the ink is not immediately discharged if the ink is not maintained in or by the first edge 37*a* or the third edge 37*c*. In this case, when the ink is leaked, there is a concern that the ink is not maintained in the second edge 37*b* and the fourth edge 37*d* of the groove portion 37 and spills. In the embodiment, by making the opening width of the second one 37*b* and the fourth edge 37*d* wide, it is possible to make a buffer which is able to maintain a large amount of the ink (compared to the volume maintained by the edges 37*a* and 37*c*), and to suppress the ink from spilling.

In addition, the discharging grooves 35 are provided so as to be communicated with the groove portion 37. In other words, on the guide wall 36, there is provided a second communication groove 35*b* which communicates with the discharging groove 35 and the groove portion 37. The ink inside the discharging groove 35 is discharged to the groove portion 37 via the first communication groove 35*a* and the second communication groove 35*b*. The ink discharged to the groove portion 37 is discharged to the outside of the recording head 1 via the communication path 38 as described above.

The second upstream flow path member 32 is fixed to the surface side opposite to the connection portion 34 of the first upstream flow path member 31, and includes a second upstream flow path 112 which communicates with the first upstream flow path 111. In addition, on a downstream side (third upstream flow path member 33 side) of the second upstream flow path 112, a first liquid remaining portion 112*a*, in which an inner diameter is expanded to be wider than that of the first upstream flow path 111, is provided.

The third upstream flow path member 33 is provided on a side of the second upstream flow path member 32 opposite to the first upstream flow path member 31. In addition, in the third upstream flow path member 33, a third upstream flow path 113 is provided. An opening part on the second upstream flow path 112 side of the third upstream flow path 113 is a second liquid remaining portion 113*a* in which the width is widened corresponding to the first liquid remaining portion 112*a*. In an opening part (between the first liquid remaining portion 112*a* and the second liquid remaining portion 113*a*) of the second liquid remaining portion 113*a*, a filter 39 for removing air bubbles or foreign substances included in the ink is provided. Accordingly, the ink supplied from the second upstream flow path 112 (first liquid remaining portion 112*a*) is supplied to the third upstream flow path 113 (second liquid remaining portion 113*a*) via the filter 39.

In addition, the third upstream flow path 113 diverges or splits into two paths on a further downstream side (side opposite to the second upstream flow path 112) than the second liquid remaining portion 113*a*.

In other words, the upstream flow path 110 corresponding to one connection portion 34 (liquid inlet) may include the first upstream flow path 111, the second upstream flow path 112, and the third upstream flow path 113. The upstream flow path 110 is open on the downstream flow path member 40 side as two outlets. In other words, the two outlets are provided so as to be communicated with a flow path (common flow path) which is common to both outlets.

The first upstream flow path member 31, the second upstream flow path member 32, and the third upstream flow path member 33, on which the upstream flow path 110 is provided, may be integrally stacked by the adhesive, welding, or the like. In addition, it is possible to fix the first upstream flow path member 31, the second upstream flow path member 32, and the third upstream flow path member 33 with the screw or a clamp. However, in order to suppress the leakage of ink (liquid) from the connected part from the first upstream flow path 111 to the third upstream flow path 113, it is preferable to join the upstream flow path members with the adhesive or by welding.

In addition, in one embodiment and by way of example only, four connection portions 34 are provided in one upstream flow path member 30, and four independent upstream flow paths 110 are provided in one upstream flow path member 30. Each upstream flow path 110 diverges into two flow paths on the downstream flow path member 40 side. Moreover, in one embodiment, a configuration, in which the upstream flow path 110 diverges into two at the further downstream side (downstream flow path member 40 side) than the filter 39, is described as an example. However, the configuration is not limited thereto. The upstream flow path 110 may diverge into three or more paths at the further downstream side than the filter 39 or downstream of the filter 39. In addition, one upstream flow path 110 may not diverge or split at the further downstream side than the filter 39 or on the downstream side of the filter 39.

The downstream flow path member 40 may include the downstream flow path 120 which is connected to the upstream flow path 110. In one embodiment, the downstream flow path 120 is configured to include the flow path which extends in the third direction Z or the flow path which extends in a direction that intersects with the third direction Z, according to the position of the inlet 14 of the head body 10.

In addition, amongst the plurality of head bodies 10 in one embodiment, two head bodies 10 are fixed to the surface side opposite to the upstream flow path member 30 in the downstream flow path member 40. Here, in one head body 10, as described above, a nozzle group (nozzle row) is formed to be arranged in the second direction Y. In the recording head 1, two head bodies 10 are provided to be in parallel in the second direction Y.

In addition, a fixing method between the flow path member 20 and the head body 10 is not particularly limited. For example, the fixing method may be the adhesion by the adhesive or the fixation by the screw. However, because the size of the head body 10 is small and the plurality of the head bodies 10 needs to be attached to one flow path member 20, it is difficult to fix the flow path member 20 and the head bodies 10 via the seal member made of the elastic material. Therefore, it is preferable to attach the head body 10 and the flow path member 20 by or with the adhesive.

In addition, in the downstream flow path member 40, a wiring member insertion through-hole 41 for inserting the wiring member 13 of the head body 10 is provided. The insertion through-hole 41 penetrates in the third direction Z.

Between the upstream flow path member 30 and the downstream flow path member 40, the seal member 50 is provided. The seal member 50 is a coupler that connects (continues) the upstream flow path 110 and the downstream flow path 120.

The seal member 50 can include a material (elastic material) which has a liquid resistance with respect to the liquid, such as ink used in the recording head 1, and is elastically deformable. For example, rubber or elastomer can be used. In the seal member 50, a communication flow path 130, which communicates with the upstream flow path 110 and the downstream flow path 120, is provided. In one embodiment, the seal member 50 is formed of one member with respect to the plurality of upstream flow paths 110 and the downstream flow paths 120. In other words, the plurality of communication flow paths 130 are formed on or in one seal member 50. The seal member 50 is not particularly limited thereto. The plurality of seal members 50 may be provided so as to be independent or separate for every communication flow path 130 which connects the upstream flow path 110 and the downstream flow path 120.

In addition, the seal member 50 of may be maintained in a state where pressure is applied in the third direction Z between the upstream flow path member 30 and the downstream flow path member 40. In other words, the upstream flow path 110 and the communication flow path 130 of the upstream flow path member 30 are connected to each other in a state where pressure is applied in the third direction Z in the seal member 50 or to the seal member 50. In addition, the communication flow path 130 and the downstream flow path 120 are connected to each other in a state where pressure is applied in the third direction Z in or to the seal member 50.

In addition, the seal member 50 is not limited thereto, and may connect the upstream flow path and the communication flow path, and the communication flow path and the downstream flow path by applying pressure in the first direction which is a radial direction of the flow path and in the surface direction of the second direction, for example. In other words, when pressure is applied in the radial direction of the flow path, a tubular part (tube) in which the communication flow path 130 is provided inside the seal member 50 may be provided. The seal member 50 may be adhered to an inner circumferential surface or to an outer circumferential surface of the tubular part.

In addition, between the seal member 50 and the downstream flow path member 40, the wiring substrate 60 to which the wiring member 13 is connected is provided.

On the wiring substrate 60, the wiring or the electronic component (not illustrated) are mounted. The wiring (not illustrated) is connected to the connector 61 which is provided on both end portion sides in the second direction Y. The outer portion wiring (not illustrated) for supplying a printing signal or the like is connected to the connector 61 in one example. In addition, in the flow path member 20, a connector connection port 21 is provided for exposing the connector 61 to both side surfaces in the second direction Y, and the outer portion wiring is connected to the connector 61 exposed by the connector connection port 21.

In this manner, the vicinity of the connector 61 which is provided in the recording head 1 can be sealed by a part of the seal member 50 which connects the flow paths therebetween or by another sealing member. When the ink is attached to the inside of the connector 61, the wiring inside the connector 61 is short-circuited. In addition, even when the vicinity of the connector 61 is sealed and the ink is not likely to be infiltrated into the inside of the recording head 1, there is a concern that the ink may leak into the inside if the ink is attached to or leaked in the vicinity of the connector 61, and that the wiring or the electronic component may be damaged by the infiltrated ink. For this reason, in the vicinity of the connector 61, it is preferable not to allow the attachment of the ink.

In one embodiment, because the groove portion 37 is provided as described above, and because the communication path 38 which communicates with the groove portion 37 is open to a surface which is different from a surface on which the connector connection port 21 is provided, that is, one surface in the first direction X, the ink (leaked ink or the like) attached to the further inner side than the groove portion 37 of the flow path member 20 is discharged to the surface from the communication path 38 via the groove portion 37. This surface to which the leaked ink is discharged is different from the surface on which the connector 61 is provided. Therefore, the ink is not likely to be attached to the connector 61, and it is possible to suppress the wiring from being short circuited by the leaked ink or the electronic component from being damaged.

In addition, the fixing method of the upstream flow path member 30 and the downstream flow path member 40 may be fastened by the screw or the adhesion by the adhesive. In one embodiment, by fastening the upstream flow path member 30 and the downstream flow path member 40 by the screw, it is possible to easily disassemble the upstream flow path member 30 and the downstream flow path member 40. Therefore, it is possible to replace any one of the upstream flow path member 30 and the downstream flow path member 40 which has a defect, and it is possible to improve the yield compared to replacing the entire flow path member 20. In addition, because the upstream flow path member 30 can be easily attached to and detached from the downstream flow path member 40, it is possible to easily perform backwashing that washes out the foreign substances in the upstream flow path 110 or on the filter 39 by causing a cleaning solution to reversely flow in the upstream flow path 110 of the upstream flow path member 30.

In addition, on the surface side on which the head body 10 of the flow path member 20 is provided, the cover head 70 which exposes the nozzle and protects the head body 10 is provided.

Furthermore, on the flow path member 20, the cover member 80 is provided on the surface side opposite to the head body 10, that is, on the connection portion 34 side.

The cover member 80 includes a bottom surface portion 81 which has substantially the same area as the surface of the upstream flow path member 30 opposite to the downstream flow path member 40 and a wall portion 82 which is provided to protrude (rise) on the side opposite to the upstream flow path member 30 in the third direction Z to surround the bottom surface portion 81.

On the bottom surface portion 81, an opening portion 83 which exposes the recessed portion **36*a* is provided. In one embodiment, the opening portion 83 is formed at a size for opening the wall surface of the recessed portion 36*a* side of the groove portion 37. Without opening the wall surface on the side opposite to the recessed portion 36*a* of the groove portion 37, the bottom surface portion 81 is formed at a size for covering a part of the opening on the side opposite to the recessed portion 36*a* of the groove portion 37. In other words, the bottom surface portion 81 is provided by opposing the wall surface opposite to the recessed portion 36*a* of the groove portion 37. Accordingly, a part of the groove portion 37 is open by the opening portion 83 of the bottom surface portion 81**.

By providing the cover member 80, even when the ink is attached to any region of the surface on which the connection portion 34 is provided in the recording head 1, it is possible to guide the ink into the groove portion 37, and to discharge the ink inside the groove portion 37 to the outside of the recording head 1 from the communication path 38. In other words, the ink leaked to the outer side (side opposite to the recessed portion **36*a*) of the groove portion 37 flows into the groove portion 37 along the surface of the bottom surface portion 81 of the cover member 80. Accordingly, flow of the ink attached to the connection portion 34 side of the recording head 1 can suppress outflow of the ink be suppressed from flowing to a region where the connector 61 is provided. Damage to the wiring of the connector 61 or the electronic components of the recording head 1** due to the leaked ink can be suppressed.

In addition, in one embodiment, because the ink can be discharged from the communication path 38, it is possible to suppress the contamination of a recording medium, such as a paper sheet, caused by the ink leaked from an unexpected flow region.

Moreover, in the ink jet type recording apparatus which maintains the recording head 1, an ink receiver which receives the ink discharged from the communication path 38 may be provided.

In addition, the bottom surface portion 81 may be provided to be inclined toward the opening portion 83. In other words, the surface thereof may be provided to be inclined so that the opening portion 83 side is low on the upstream flow path member 30 side (lower side in a vertical direction), and so that the side opposite to the opening portion 83, that is, the wall portion 82 side is high (upper side in a vertical direction) in contrast to the upstream flow path member 30. Accordingly, the ink attached to the surface of the bottom surface portion 81 can easily move to the opening portion 83 side.

In addition, in one embodiment, the wall portion 82 may be continuously provided along the circumferential direction of the bottom surface portion 81, for example, and the liquid maintaining portion, such as the ink cartridge, is fixed. In addition, the wall portion 82 may not be continuously provided along the circumferential direction of the bottom surface portion 81. In other words, the wall portion 82 may be provided only on one side of the bottom surface portion 81 in the first direction X or on one side of the bottom surface portion 81 in the second direction Y. In addition, the wall portion 82 may not be provided. In other words, the cover member 80 may be configured to only have the bottom surface portion 81. However, by providing the wall portion 82, the wall portion 82 can suppress to outflow of the ink attached to the bottom surface portion 81 to a region other than the groove portion 37.

In the recording head 1, the ink from the liquid maintaining portion connected to the connection portion 34 is supplied to the head body 10 via the upstream flow path 110 and the downstream flow path 120 of the flow path member 20, and is discharged as ink droplets from the liquid ejecting surface 12 of the head body 10 corresponding to the recording signal from the outer portion wiring.

The ink, which may be leaked to the connection portion when the liquid maintaining portion is attached and detached, or the like, is discharged to the groove portion 37 basically from the discharging groove 35 via the first communication groove 35*a* and the second communication groove 35*b*, and is discharged to the outside of the recording head 1 from the groove portion 37 via the communication path 38.

In addition, the ink, which is leaked to the outer side of the discharging groove 35, that is, to the inside of the recessed portion 36*a*, is discharged to the groove portion 37 via the discharging groove 35, the first communication groove 35*a*, and the second communication groove 35*b*, and is discharged to the outside of the recording head 1 from the groove portion 37 via the communication path 38.

Furthermore, the ink, which is leaked to the outer side of the recessed portion 36*a*, that is, directly to the groove portion 37 or to the outside (bottom surface portion 81) of the opening of the groove portion 37, is discharged to the groove portion 37 via the surface of the bottom surface portion 81, and is discharged to the outside of the recording head 1 from the groove portion 37 via the communication path 38.

In other words, even when the connection portion 34 of the recording head 1 is in any region of the provided surface, the leaked ink is discharged to the groove portion 37, and is discharged to the outside of the recording head 1 from the groove portion 37 via the communication path 38.

Since the leaked ink of the recording head 1 is discharged to the outside from the communication path 38, it is possible to suppress the attachment of the ink to the region other than the region to which the communication path 38 opens. Particularly, by suppressing the attachment of the ink to the connector 61 or the like, it is possible to suppress short circuiting of the wiring or the damage to the electronic components, and to suppress the contamination of the recording medium caused by the ink.

In the above, embodiments of the present invention were described, but the basic configuration of the present invention is not limited to the above description.

For example, a recording head 1 provided with two head bodies 10 is described above, but the number of the head bodies 10 is not particularly limited thereto. The recording head 1 may have one head body 10, or may have three or more head bodies 10.

In addition, a configuration has been described in which the communication path 38 is open on a side surface (a surface which intersects with a surface on which the connection portion 34 is provided) of the recording head 1 an example, but the configuration is not particularly limited thereto. For example, the communication path 38 may be open on a surface opposite to the surface on which the connection portion 34 is provided, that is, on the liquid ejecting surface 12 side. The communication path 38 may be, for example, provided to penetrate the flow path member 20 in the third direction Z.

Furthermore, the recording head 1 having the cover member 80 is described above as an example, but the recording head is not limited thereto. The recording head 1 may not have or include the cover member 80. However, on an outer circumference of the surface on which the connection portion 34 of the recording head 1 is provided, a risen wall portion may be provided and it is possible to suppress infiltration of the ink (liquid) into the unexpected region, such as the surface on which the connector 61 is provided, by the risen wall portion.

In addition, the flow path member 20, which includes the upstream flow path member 30 that is provided with the upstream flow path 110, and the downstream flow path member 40 that is provided with the downstream flow path 120, are described above as an example. However, for example, when the ink (liquid) is circulated, the upstream and the downstream flow paths may be reversed. In other words, by causing the ink supplied to the head body 10 to flow from the downstream flow path 120 to the upstream flow path 110, the ink may be discharged (circulated) to the liquid maintaining portion or a storing portion in which the discharged ink is stored.

Figure 5:
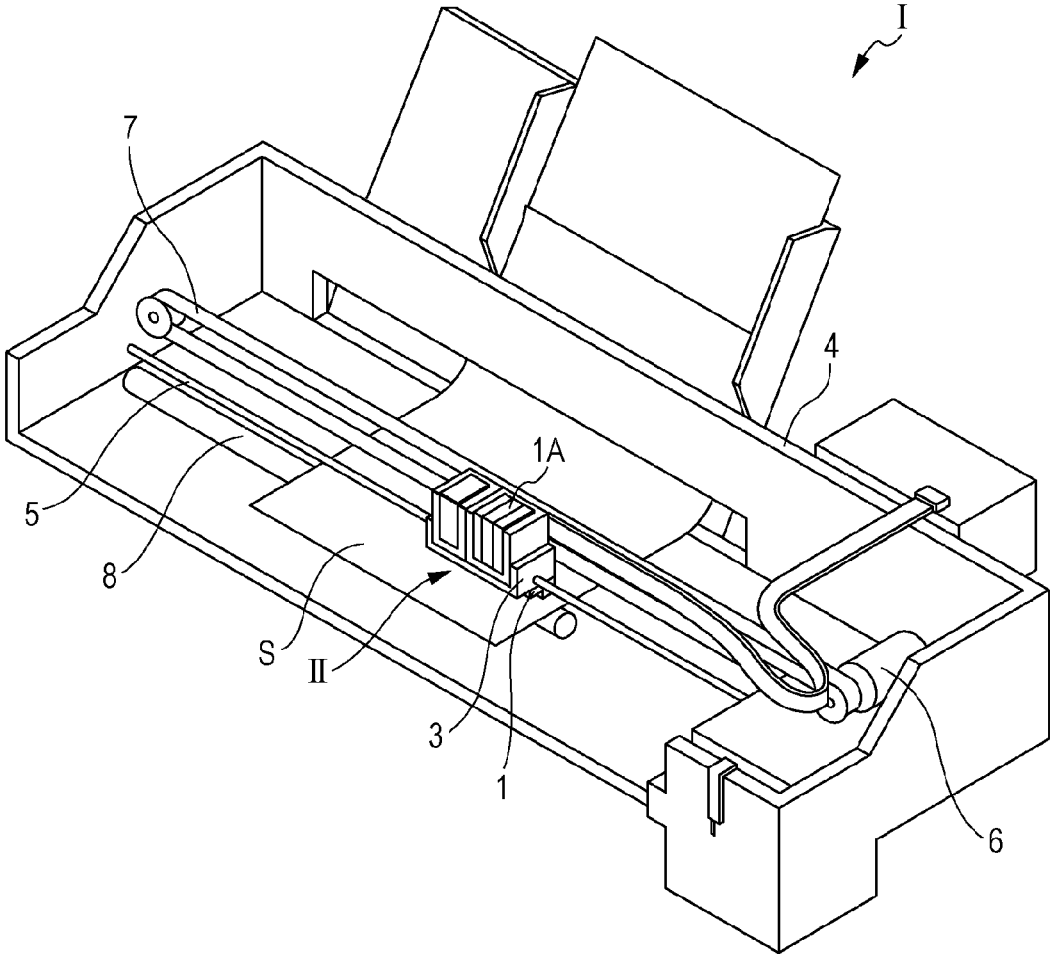
FIG. 5 is a schematic perspective view of an example of a recording apparatus.

In addition, the ink jet type recording head 1 may constitute a part of an ink jet type recording head unit provided with the ink flow path which penetrates the ink cartridge or the like, and is mounted on the ink jet type recording apparatus. FIG. 5 is a schematic view illustrating an example of the ink jet type recording apparatus.

In an ink jet type recording apparatus I illustrated in FIG. 5, an ink jet type recording head unit II (hereinafter, referred to as a head unit II) having a plurality of ink jet type recording heads 1 is provided with an ink cartridge 2 which is detachable and constitutes the liquid maintaining portion. A carriage 3 on which the head unit II is mounted is provided in an axially movable manner in a carriage axis 5 to which an apparatus body 4 is attached. The recording head unit II discharges, for example, a black ink composition or a color ink composition.

As a driving force of a driving motor 6 is transmitted to the carriage 3 via a plurality of gears (not illustrated) and a timing belt 7, the carriage 3 on which the head unit II is mounted moves along the carriage axis 5. Meanwhile, in the apparatus body 4, a platen 8 is provided along the carriage axis 5, and a recording sheet S, which is a recording medium, such as a paper sheet fed by a paper feeding roller (not illustrated) or the like, is wound around the platen 8 and transported.

In addition, in the above-described ink jet type recording apparatus I, the ink jet type recording head 1 (head unit II) is described as an example of an ink jet type recording head which is mounted on the carriage 3 and moves in the main scanning direction, but is not particularly limited thereto. For example, embodiments of the present invention can be employed to a so-called line type recording apparatus in which the ink jet type recording head 1 is fixed and printing is performed only by moving the recording sheet S, such as the paper sheet, in the auxiliary or sub scanning direction.

In addition, in the above-described example, the ink jet type recording apparatus I has a configuration in which the ink cartridge 2 which is the liquid maintaining portion is mounted on the carriage 3, but is not limited thereto. For example, the liquid maintaining portion, such as the ink tank, may be fixed to the apparatus body 4, and the liquid maintaining portion and the ink jet type recording head 1 may be connected to each other via a supply tube, such as a tube. In addition, the liquid maintaining portion may not be mounted on the ink jet type recording apparatus.

Furthermore, the target of embodiments of the present invention widely includes the liquid ejecting head in general. For example, embodiments of the present invention can be employed to or implemented in a recording head, such as various ink jet type recording heads used in an image recording apparatus, such as a printer, a coloring material ejecting head used in manufacturing a color printer, such as a liquid crystal display, an electrode material ejecting head used in forming the electrode, such as an organic EL display or a field emission display (FED), or a bio-organic material ejecting head used in manufacturing a bio-chip.

What is claimed is:

1. A liquid ejecting head comprising:

a liquid inlet which is provided on one surface of the liquid ejecting head and to which a liquid maintaining portion that maintains liquid is connected;

a recessed portion in which the liquid inlet is provided on an inner side and which is open to the one surface;

a groove portion that is open to the one surface and which is continuously provided across a vicinity of the recessed portion on an outer side of the recessed portion; and a communication path which communicates with a side surface where the groove portion and the one surface intersect with each other, or with a surface opposite to the one surface, wherein the groove portion includes a first area in contact with the communication path, a second area in contact with the communication path, a third area that is not in contact with the communication path, and a fourth area that is not in contact with the communication path, wherein widths of the first area and the second area are narrower than widths of the third area and the fourth area.

2. The liquid ejecting head according to claim 1, further comprising an opening which exposes the recessed portion; and a cover member which is formed from an outer side of the groove portion to a region that opposes a wall surface of the outer side of the groove portion.

3. The liquid ejecting head according to claim 1, wherein the recessed portion is formed by a guide wall for positioning the liquid maintaining portion provided in the vicinity of the connection portion.

4. The liquid ejecting head according to claim 1, further comprising a wiring substrate having a connector to which an outer portion wiring is connected, wherein the connector is disposed on a surface different from a surface on which the communication path opens.

5. The liquid ejecting head according to claim 1, wherein a discharging groove having a recessed shape along a circumferential direction is provided in the vicinity of the liquid inlet, and wherein the discharging groove is communicated with the groove portion.

6. The liquid ejecting head of claim 1, further comprising:

a guide wall that is arranged to surround a vicinity of the liquid inlet, wherein the recessed portion is defined by the guide wall and wherein the liquid inlet is provided on an inner side of the recessed portion.

7. The liquid ejecting head of claim 1, wherein:

the recessed portion is defined by a guide wall, and the liquid inlet is provided on an inner side of the recessed portion, the liquid ejecting head further comprising:

a discharging groove formed in a bottom surface of the recessed portion, wherein a base end of the liquid inlet is disposed in the discharging groove.

8. The liquid ejecting head of claim 1, wherein:

the recessed portion is defined by a guide wall, and the liquid inlet is provided on an inner side of the recessed portion, the liquid ejecting head further comprising:

a discharging groove formed in a bottom surface of the recessed portion, wherein the discharging groove communicates with the groove portion at a location in the guide wall.

9. The liquid ejecting head of claim 1, wherein the groove portion is open to the one surface and is continuously provided across a vicinity of the recessed portion on an entirety of an outer side of the recessed portion.

10. A liquid ejecting apparatus, comprising:

the liquid ejecting head according to claim 1.

11. A liquid ejecting apparatus, comprising:

the liquid ejecting head according to claim 2.

12. A liquid ejecting apparatus, comprising:

the liquid ejecting head according to claim 3.

13. A liquid ejecting apparatus, comprising:

the liquid ejecting head according to claim 4.

14. A liquid ejecting apparatus, comprising:

the liquid ejecting head according to claim 5.

* * * * *